United States Patent [19]

Näslund

[11] Patent Number: 4,656,697

[45] Date of Patent: Apr. 14, 1987

[54] BAG CLIP

[76] Inventor: Jan I. Näslund, Vassvägen 21, S-141 39 Huddinge, Sweden

[21] Appl. No.: 712,864

[22] Filed: Mar. 18, 1985

[30] Foreign Application Priority Data

Mar. 26, 1984 [SE] Sweden ..... 8401657

[51] Int. Cl.[4] ..... B77D 77/10

[52] U.S. Cl. ..... 24/30.5 P; 24/543; 24/560; 24/561

[58] Field of Search ..... 251/10; 24/30.5 P, 30.5 R, 24/487, 559, 543, 556, 560, 561, 564; 128/326, 346

[56] References Cited

U.S. PATENT DOCUMENTS

| | | | |
|---|---|---|---|
| 1,600,684 | 9/1926 | McGibbon | 24/543 |
| 2,796,065 | 6/1957 | Kapp | 128/346 |
| 3,363,293 | 1/1968 | Nemrod et al. | 24/30.5 P |
| 3,706,312 | 12/1972 | Melges | 128/346 X |
| 3,874,042 | 4/1975 | Eddleman et al. | 251/10 X |
| 3,978,555 | 9/1976 | Weisenthal | 24/543 |
| 4,038,726 | 8/1977 | Takabayashi | 24/543 X |
| 4,346,869 | 8/1982 | MacNeill | 128/346 X |
| 4,416,038 | 11/1983 | Morrone, III | 24/543 X |
| 4,523,353 | 6/1985 | Hubbard et al. | 24/30.5 R |

FOREIGN PATENT DOCUMENTS

| | | | |
|---|---|---|---|
| 57887 | 8/1982 | European Pat. Off. | 24/30.5 R |
| 1412518 | 8/1965 | France | 24/30.5 P |

*Primary Examiner*—Kenneth J. Dorner
*Assistant Examiner*—James R. Brittain
*Attorney, Agent, or Firm*—Pasquale A. Razzano

[57] ABSTRACT

A bag clip for tightly sealing plastic bags. The bag clip comprises two limbs (1, 2) hinged together at respective one ends thereof and intended to receive therebetween that portion of the bag where a seal is to be effected when the limbs are moved towards one another with the bag portion therebetween, wherewith the other ends of the limbs have arranged thereon a manually openable snap-lock arrangement (8–11, 13, 14) which closes automatically when the limbs are brought together to a sufficient extent. Each of the mutually facing surfaces of the limbs (1, 2) has arranged thereon an opposing channel, the one channel (4) being wider than the other channel (20), with upstanding free channel walls. The walls (3*a*, 3*b*) of the narrower channel are intended to be pressed in between the walls (6*a*, 6*b*) of the wider channel with the bag material therebetween, and the walls (3*a*, 3*b*) of the narrower channel can be elastically pressed in towards one another by the walls (6*a*, 6*b*) of the wider channel, the parts of said walls (6*a*, 6*b*) being chamfered (7), so that this channel (4) is wider at its upper region than further down along the height of its walls (6*a*, 6*b*).

2 Claims, 5 Drawing Figures

BAG CLIP

The present invention relates to a bag clip, particularly intended for tightly sealing plastic bags at any location along the height of the bag or at a location adjacent the bag opening.

In the case of narrow bags whose width is not greater than the length of the clip, the bag can be gathered and clamped by the clip at any location along the height of the bag, and several clips can be used to divide the bag into a plurality of mutually superposed compartments. In the case of bags whose width is greater than the length of the clip, the bags are preferably sealed at the upper ends, by gathering the bag material together and placing the gathered portion of the bag in the clip.

The object of the invention is to provide, in simple fashion, a guarantee that the clip seals the bag in a liquid-tight manner. This object is realized with the aid of a bag clip designed in accordance with the invention and having the characteristic features set forth in the claims.

The invention will now be described in more detail with reference to an embodiment thereof illustrated in the accompanying drawing, in which FIG. 1 is a perspective view of the bag clip according to the invention in a closed and locked state;

The bag clip according to the invention comprises two limbs 1 and 2 which are hinged together at one end thereof by means of a score fold 12. The limbs are provided at the other ends thereof with a snap-lock arrangement 8–10, by means of which the limbs can be locked together. The clip is manufactured as a single-piece structure from a plastics material of suitable elasticity or resilience, with the aid of known plastic or pressure moulding techniques.

Figure 3:
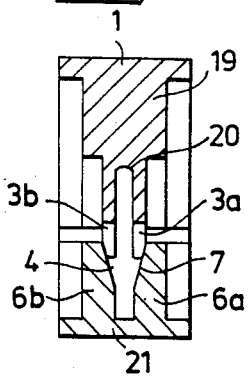
FIG. 3 is a sectional view of a closed, unloaded clip.

Extending from the bottom 18 of the limb 1 is a ridged portion 19 having reinforcing ribs 5 which extend outwardly along both sides of the ridge 19 at right angles to the bottom 18. Arranged on the free upper part of the ridge are two mutually parallel legs 3*a*, 3*b*, which are mutually separated by a central channel 20 (FIG. 3).

Figure 4:
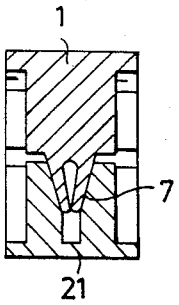
FIG. 4 is a sectional view of the clip when fully clamped together and locked.
Figure 5:
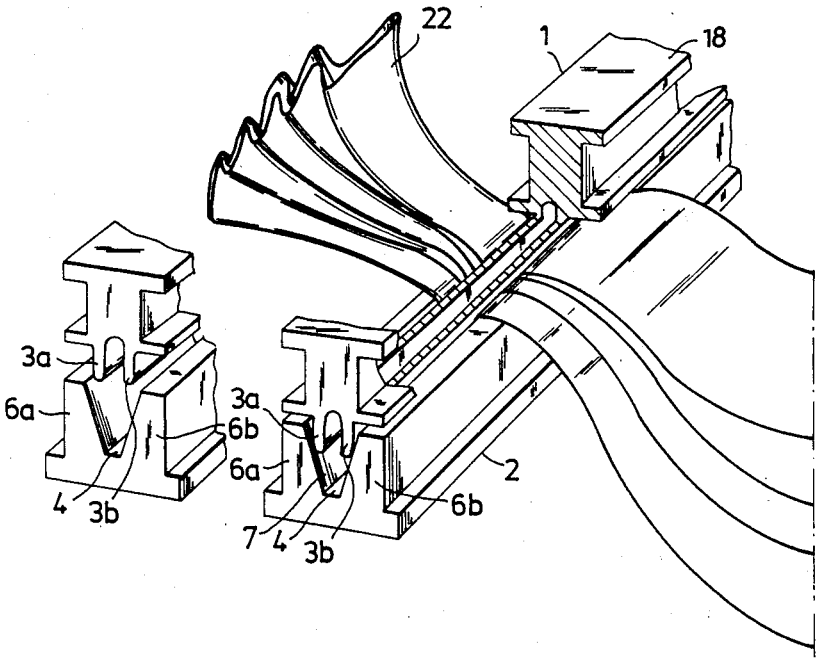
FIG. 5 is a partly sectional view of a cut out part of the clip in larger scale than FIGS. 1–4.

The other limb 2 has a longitudinally extending channel 4 defined by two legs 6*a*, 6*b* upstanding from the bottom of said limb, the edges of which legs are chamfered or wedge-shaped at 7. The parts 6*a*, 6*b* and 3*a*, 3*b*, together with the chamfers 7, are so dimensioned that when moving the limbs 1 and 2 together, to reach the position illustrated in FIGS. 1 and 4, the legs 3*a*, 3*b* are urged towards one another, while guided by the chamfers 7, to tightly clamp between the limbs part of a bag, e.g. a plastics bag 22 (FIG. 5) inserted therebetween. The channel 4 is wider than the other channel 20 with upstanding free channel walls, of which the walls 3*a*, 3*b* of the narrower channel are intended to be pressed in between the walls 6*a*, 6*b* of the wider channel with the bag material therebetween. The walls 3*a*, 3*b* of the narrower channel can be elastically urged towards one another by the walls 6*a*, 6*b* of the wider channel, the upper surfaces of said walls 6*a*, 6*b* of the wider channel being chamfered 7 so that this channel 4 is wider in its upper region than further down the height of its walls 6*a*, 6*b*. As illustrated at 16 and 15, the limb 1 is rounded at both ends thereof, as is also the end 17 of the limb 2 adjacent the fold 12. Arranged on the free end 15 of the limb 1 is an outwardly projecting shoulder 8.

Figure 1:
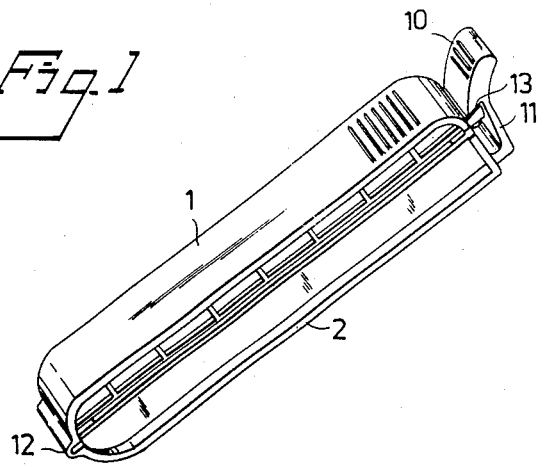
Figure 2:
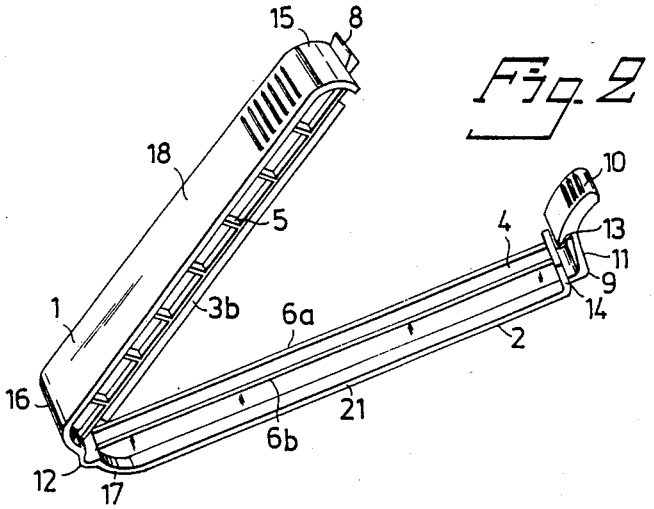
FIG. 2 is a perspective view of the bag clip when open.

Arranged on the free end of the limb 2 is a lock tab which at its outermost part has a serrated tongue 10, for releasing the locking action between the limbs 1, 2. The tongue 10 is connected to the bottom 21 of the limb 2 via a shaft 11 and a knuckle bend 9. Located on the bottom of the tongue 10 or beneath the tongue facing the shaft 11 is a further shoulder 13 intended to co-act in a locking mode with the locking shoulder 8 of the limb 1, in accordance with FIG. 1. The limb 2 is terminated at its free end with an upstanding wall 14, which extends at right angles to both the bottom 21 and the legs 6*a*, 6*b*. It will be understood that when the limbs 1 and 2 are moved together to a sufficient extent they will automatically lock together at their free ends and that in order to unlock the limbs from one another it is necessary to press the tongue 10 to the right and downwardly, as seen in FIG. 1.

It will also be understood that the bag clip can be used with narrow bag widths, not exceeding the length of the clip, and with wider bags, in which case the upper part or neck portion of the bag is gathered or twisted together prior to placing the clip therearound. The illustrated clip construction also enables bags to be tightly sealed, so as to prevent liquid material escaping therefrom.

I claim:

1. A bag clip for tightly sealing a bag, comprising a first limb and a second limb hinged together at one of their respective ends, said limbs being openable to receive therebetween that portion of the bag where a seal is to be effected and closeable together to seal said bag, said limbs further having at their other respective ends a manually openable snap-lock device which automatically closes when said limbs are brought together to a sufficient extent, said limbs further having back portions and facing portions, said facing portions opposing one another to effect the seal on said bag when said limbs are brought together, said facing portion of said first limb having a pair of spaced-apart upstanding longitudinally parallel relatively thick walls defining a first longitudinal channel therebetween, the interior of said channel being wedge-shaped so that it is wider at the mouth thereof and narrows further down the height of said walls, said back portion of said second limb having a plurality of transverse reinforcing ribs so that said back portion is relatively rigid, said facing portion of said second limb having a pair of spaced-apart upstanding longitudinally parallel legs which are substantially thinner than said thick walls of said first limb and relatively more elastic than the back portion of said second limb, said legs defining a second channel therebetween, said pair of legs, including their included second channel, having a narrower width than the mouth of said first channel so that when said legs are pressed into the wedge-shaped interior of said first channel when said clip is closed with the bag material therebetween, the pair of legs are elastically brought together bit by bit as said pair of legs are pressed into the wedge-shaped interior of said first channel.

2. A bag clip for tightly sealing a bag, comprising a first limb and a second limb hinged together at one of their respective ends, said limbs being openable to receive therebetween that portion of the bag where a seal is to be effected and closeable together to seal said bag, said limbs further having at their other respective ends a manually openable snap-lock device which automatically closes when said limbs are brought together to a sufficient extent, said limbs further having back portions and facing portions, said facing portions opposing one another to effect the seal on said bag when said limbs are brought together, said facing portion of said first limb having a pair of spaced-apart upstanding longitudinally parallel relatively thick walls defining a first longitudinal channel therebetween, the interior of said channel being wedge-shaped so that it is wider at the mouth thereof and narrows further down the height of said walls, said back portion of said second limb being relatively rigid, said facing portion of said second limb having a pair of spaced-apart upstanding longitudinally parallel legs which are substantially thinner than said thick walls of said first limb and relatively more elastic than the back portion of said second limb, said legs defining a second channel therebetween, said pair of legs, including their included second channel, being of a narrower width than the mouth of said first channel so that when said legs are pressed into the wedge-shaped interior of said first channel when said clip is closed with the bag material therebetween, the pair of legs are elastically brought together bit by bit as said pair of legs are pressed into the wedge-shaped interior of said first channel until said legs are fully brought together to contact one another when said clip is fully closed and locked.

* * * * *